United States Patent [19]

Mikhail

[11] Patent Number: 4,715,622

[45] Date of Patent: Dec. 29, 1987

[54] POSTAL STAMP WITH PROVISIONS FOR ENTERING MACHINE READABLE DESTINATION IDENTIFIER

[76] Inventor: Ameer G. Mikhail, 2103 Windom Ct., Bel Air, Md. 21014

[21] Appl. No.: 819,298

[22] Filed: Jan. 16, 1986

[51] Int. Cl.[4] ..... B42D 15/00

[52] U.S. Cl. ..... 283/71; 283/81; 209/900

[58] Field of Search ..... 209/900; 283/71, 1 R, 283/81

[56] References Cited

U.S. PATENT DOCUMENTS

| | | | |
|---|---|---|---|
| 1,131,464 | 3/1915 | Besaw | 283/71 |
| 3,774,758 | 11/1973 | Sternberg | 283/71 X |
| 3,933,094 | 1/1976 | Murphy et al. | 209/900 X |

*Primary Examiner*—Paul A. Bell
*Attorney, Agent, or Firm*—Walter G. Finch

[57] ABSTRACT

A postal decal (stamp) which may be purchased regularly as a stamp is developed such that it carries a separable part of which is available for entering a destination identifier code (e.g. zip code) with the proper tool which can be a pen or pencil. These identifiers are written such that they are machine readable. Thus the process of sorting the mail and parcels to their destination can be greatly enhanced together with less human intervention for sorting. These stamps may be obtained at the usual post offices. If special pens or pencils are needed, they can be provided also at those post offices or at any other outlet. A second type of stamp is developed where the part designated for entering the destination identifier is thinly coated partially or totally with a magnetic or illuminating or coloring material which can be detected by the appropriate 'reading' or scanning machine which reacts sensitively to this coating material. This coating may be in a manner so as to provide the orientation of the destination identifier with respect to a pre-prescribed direction. This detection will initiate the reading process of the code identifier. This stamp is introduced to give flexibility for the scanning machines in locating the piece carrying the destination identifier especially when it is placed on any location on the surface of the mailed item.

2 Claims, 9 Drawing Figures

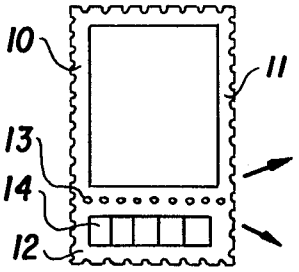
FIG. 1
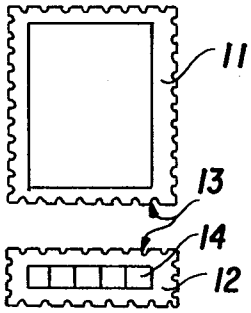
FIG. 2
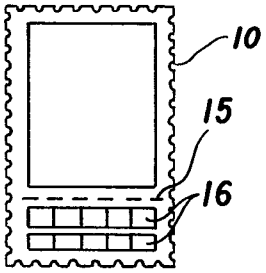
FIG. 3
FIG. 4
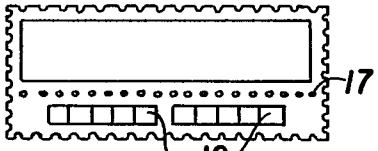
FIG. 5
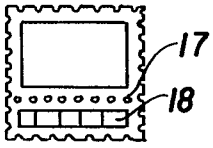
FIG. 6
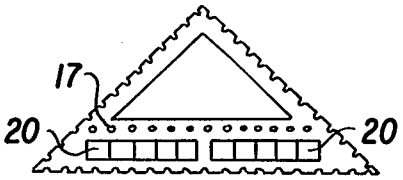
FIG. 7
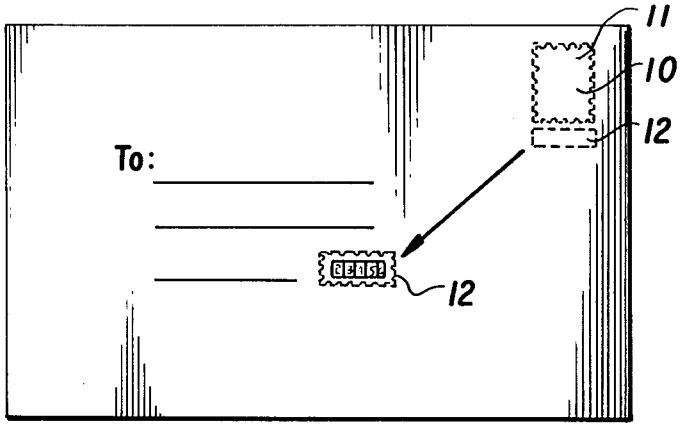
FIG. 8
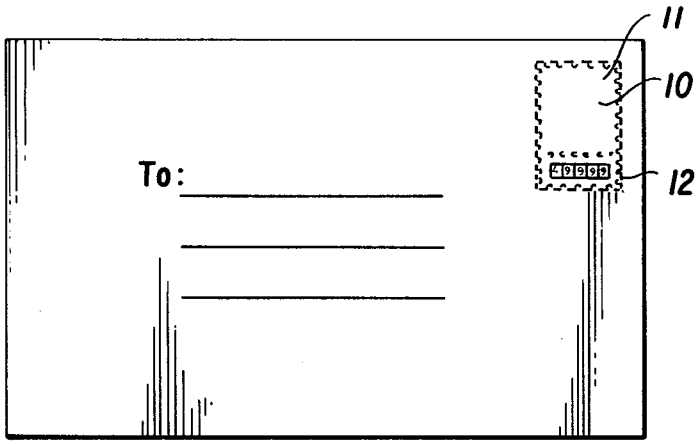
FIG. 9

POSTAL STAMP WITH PROVISIONS FOR ENTERING MACHINE READABLE DESTINATION IDENTIFIER

BACKGROUND OF THE INVENTION

This invention relates to a postal stamp or generally a decal having a means by which a postal user can enter his destination identifier, for example, a zip code, on a specified location on a postal stamp which he has purchased from places where he usually gets his regular stamps or decals. This destination identifier will be read by an automated machine at the postal centers where mail is sorted and processed to its destination.

This postal stamp will thus enable the appropriate sorting machine of direct and fast routing of pieces of mail to the proper containers marked for those destinations. This automated reading procedure will speed-up the sorting process and eliminate the human sorter who has to read-in the destination identifier on each piece of mail by his own bare eyes and then punch-in the read zip-code by his fingers in a machine which collects the sorted mail, as being done at the present time.

This invention is not intended only for the typical governmental postal service, but for private and public organizations that handle parcel, package and fast mail delivery.

In addition, this invention is not limited to postal stamps but it is rather general in nature to include postal 'decals' which can be used on larger packages and shipments. Relevant stamp inventions are given in U.S. Pat. Nos. 1,132,464 (Besaw); 3,774,758 (Sternberg); and 3,993,049 (Murphy et al).

SUMMARY OF THE INVENTION

This invention relates to means whereby a postal user can enter his destination identifier on a specified location on a postal stamp which is affixed to an envelope, where the envelope can be processed using an automated machine reading said destination identifier and then sorting and processing said envelope to its destination.

Another object of this invention is to facilitate a postal stamp with provisions for entering a destination identifier that will enable an appropriate sorting machine for direct and fast routing of pieces of mail to the proper containers marked for the designation of the identifier.

Still another object of this invention is to provide the speeding up of the sorting process by effectively utilizing the existing destination identifier codes.

Another object of this invention is to provide for the elimination of the human sorter by the novel use of a destination identifier positioned on a stamp which is placed on each article and/or envelope.

And another object of this invention is to describe a fast automated means for sorting packages, such as parcels, packages and fast mail delivery for use by private and public organizations, through the use of automated detection of destination identifier entered appropriately on the stamp.

To enable the entering of a destination identifier which can be used on postal decals for large packages and shipments, is another object of this invention.

Other attendant objects and advantages of this invention are set forth below in a description of the drawing.

BRIEF DESCRIPTION OF THE DRAWINGS

FIG. 1 is a front view of a postal stamp illustrating a first embodiment thereof;

FIG. 2 is a front view of the postal stamp of FIG. 1 showing two parts of the postal stamp;

FIG. 3 is a front view of a second embodiment of a postal stamp showing different forms of perforation and identifier marking location and size;

FIGS. 4, 5, 6 and 7 are front views of a third, fourth, fifth and sixth embodiments of a postal stamp showing other variations in shapes and sizes of postal stamps, perforations and identifier marking locations;

FIG. 8 is a front view of an envelope showing the utilization of a postal stamp on the envelope; and FIG. 9 is a front view of an envelope showing the utilization of a specifically coated postal stamp on an envelope.

DESCRIPTION OF THE PREFERRED EMBODIMENT

A thin postal decal (stamp) 10, as shown in FIG. 1, is provided which is perforated at 13 into two separable pieces 11 and 12. The circular hole perforation 13 is shown in FIG. 1. Piece 11 of the decal (stamp) 10 is to include a customary picture, monetary value, and country or organization name.

Piece 12 carries markings which may be geometric in shape, e.g. rectangular or circular, where destination identifiers, e.g. zip codes, may be written by any ordinary person using the appropriate pen or pencil. This writing is such that it is readable back by an appropriate device.

Once the identifier is read and recognized by the appropriate sorting machine, the mail piece with that identifier can then be routed accordingly to its destination by first being collected in a marked container for further processing.

Both pieces 11 and 12 of the postal stamp 10 are coated on their back surfaces by the appropriate bonding material which may be wetted before affixing to the intended surface.

FIG. 2 displays the stamp of FIG. 1 after separation of piece 12 from the piece 11.

FIG. 3 shows another variation for the perforation 15 which requires more separation force than the perforation on the outer boundaries of the two pieces 11 and 12 of FIG. 1. This is introduced to help avoid separating part 12 from part 11 during the process of separating stamps from each other or from their original sheets.

FIG. 3 also shows a different arrangement 16 for the identifier boxes (markings) to allow larger number of digits or characters for the identifier code.

Other variations of the location of the perforation 17 and the identifier marking boxes 18 (19 in FIG. 5, 20 in FIG. 7) for other familiar shapes of stamps are shown in FIGS. 4, 5, 6 and 7.

In FIG. 8, there is shown an envelope with the stamp 10 being separated into two parts 11 and 12, one piece 12 of which is filled with the identifier code (99999) and gummed at the location where the destination code is usually written. This is to facilitate the sorting, if the scanning device is set to expect the destination identifier to be placed at a prescribed location on the envelope.

A second type of stamp 10 shown in FIG. 9 and disclosed herein is one with an identifier piece 12 which is coated on its surface with thin layer of magnetic or illuminating or coloring material which can be immediately detected by a corresponding reading machine. This detection may be in a manner so as to provide the detection machine with the orientation of the identifier piece 12, as referenced by a specific direction in space. Therefore the identifier piece 12 in this case may not necessarily be separated from piece 11. Furthermore, piece 12 together with piece 11 may be placed anywhere on the surface of the mailed item. Piece 12, therefore, need not be at the location where the destination identifier is usually expected.

This special coating would trigger the scanning machine and send a signal to the machine that the identifier code was found at that location and should then be read. The identifier code itself may be written by an ordinary or special pen or pencil. FIG. 9 shows the stamp, not separated into two pieces, with the identifier boxes being filled with the destination code '99999'.

I claim:

1. A postal stamp, comprising, a sheet of thin material having two surfaces, one of said surfaces being coated with a bonding material, a perforation formed along at least one direction within the outer boundaries of said stamp across said surfaces so that said stamp may be separated into at least two pieces, one of said pieces having designated spaces and indicia positioned thereon for entering a destination identifier code which may be written in numerals, alphabets, or their combinations thereof, with said destination identifier code being readable by a scanning device.

2. A postal stamp as recited in claim 1, with said one piece of said stamp having said destination identifier code being at least partially coated with a thin special material which is detectable by a scanning source, with said one piece being positionable at any location on a base which said stamp is affixed thereto.

* * * * *